United States Patent [19]

Huang et al.

[11] Patent Number: 4,478,791

[45] Date of Patent: Oct. 23, 1984

[54] METHOD FOR IMPARTING STRENGTH AND DUCTILITY TO INTERMETALLIC PHASES

[75] Inventors: Shyh-Chin Huang, Latham; Keh-Minn Chang; Alan I. Taub, both of Schenectady, all of N.Y.

[73] Assignee: General Electric Company, Schenectady, N.Y.

[21] Appl. No.: 444,932

[22] Filed: Nov. 29, 1982

[51] Int. Cl.[3] ..... C22C 19/00

[52] U.S. Cl. ..... 420/590; 420/460; 420/445; 420/449; 75/0.5 R; 148/429

[58] Field of Search ..... 148/409, 410, 426, 427, 148/428, 429; 164/463, 47, 66.1; 75/123 B, 0.5 R; 420/441, 445, 449, 460, 590

[56] References Cited

U.S. PATENT DOCUMENTS

| | | | |
|---|---|---|---|
| Re. 28,681 | 1/1976 | Baldwin | 420/449 |
| 3,902,900 | 9/1975 | Restall | 420/449 |
| 4,126,495 | 11/1978 | Ghosh | 148/32 |
| 4,292,076 | 9/1981 | Gigliotti | 420/445 |
| 4,359,352 | 11/1982 | Ray et al. | 148/31 |

*Primary Examiner*—L. Dewayne Rutledge
*Assistant Examiner*—Christopher W. Brody
*Attorney, Agent, or Firm*—Paul E. Richford; James C. Davis, Jr.; James Magee, Jr.

[57] ABSTRACT

A method for achieving both improved high strength and improved ductility in intermediate phases is provided. The method, briefly stated, comprises the steps of providing a melt whose composition substantially corresponds to that of a preselected intermetallic phase having a crystal structure of the $L1_2$ type, such as nickel aluminide, modified with from about 0.01 to 2.5 atomic percent boron, and rapidly solidifying the melt at a cooling rate of at least about $10^{3°}$ C./second to form a solid body, the principal phase of which is of the $L1_2$ type crystal structure in either its ordered or disordered state.

24 Claims, 3 Drawing Figures

0 0.5 1.0 2.0

ATOMIC PERCENT BORON

METHOD FOR IMPARTING STRENGTH AND DUCTILITY TO INTERMETALLIC PHASES

BACKGROUND OF THE INVENTION

In many systems composed of two or more metallic elements there may appear, under some conditions of composition and temperature, phases other than the primary solid solutions which are commonly known as intermediate phases. Many intermediate phases are referred to by means of a Greek symbol or formula, e.g., $Cu_3Al$, CuZn and $Mg_2Pb$, or both, although it is generally observed that many such so-called stoichiometric intermediate phases exist over a range of temperatures and compositions. Occasionally, as in the case of $Mg_2Pb$ found in the Mg-Pb system, a true practically completely ordered stoichiometric compound is formed which is properly called an intermediate compound. If, in addition, the elements of the compound are regarded as metallic, the intermediate compound is commonly called an intermetallic compound.

Intermediate phases often exhibit properties entirely different from those of the component metals comprising the system and frequently have complex crystallographic structures. The lower order of crystal symmetry and fewer planes of dense atomic population of those complex crystallographic structures may be associated with the differences in properties, e.g., greater hardness, lower ductility, and lower electrical conductivity of the intermediate phases compared to the properties of the primary (terminal) solid solutions.

Although several intermetallic compounds with otherwise desirable properties, e.g., hardness, strength, stability, and resistance to oxidation and corrosion at elevated temperatures, have been identified, their characteristic lack of ductility has posed formidable barriers to their use as structural materials.

Recently, as described by Aoki and Izumi in the Journal of the Japan Institute of Metals (vol. 43, p. 358, 1979), microalloying of the intermetallic phase $Ni_3Al$ with trace amounts of boron (0.05 and 0.1 wt. %) proved successful in increasing the ductility of that otherwise brittle and non-ductile intermetallic. Although the room temperature tensile strain at fracture of the $Ni_3Al$ with boron was improved to about 35%, compared to about 3% for $Ni_3Al$ without boron, the room temperature yield strength remained at about 30 ksi.

It would be highly desirable if there were available a simple, direct method by which both the strength and the ductility of intermetallic phases could be increased while maintaining or improving upon the desirable attributes of the intermetallic phases such as stability and resistance to oxidation and corrosion at elevated temperatures.

SUMMARY OF THE INVENTION

The method of this invention provides a simple, direct method for obtaining both strength and ductility at heretofore unprecedented levels in intermetallic phases while maintaining or improving upon the other desirable attributes of the intermetallic phase selected for processing by the method of this invention. In the method of this invention, the above-described unique combination of properties is obtained in the selected intermediate phase directly in the as-cast condition.

Briefly and generally described, the method of the invention comprises the steps of providing a melt whose composition substantially corresponds to that of a preselected intermetallic phase having a crystal structure of the $Ll_2$ type and cooling the melt at a cooling rate of at least about $10^{3°}$ C./sec to form a solid body, the principal phase of which is of the $Ll_2$ type crystal structure in either its ordered or disordered state. The melt composition is selected such that it consists essentially of a first component, a second component, and incidental impurities, modified with boron in an amount of from about 0.01 to 2.5 at.%, wherein the first component is at least one element selected from the group consisting of Ni, Fe, Co, Cr, Mn, Mo, W and Re and the second component is at least one element selected from the group consisting of Al, Ti, Nb, Ta, V, Si, Mo, W and Re. The melt composition is further selected such that the first and second components are present in the melt in an atomic ratio of approximately 3:1, respectively.

DETAILED DESCRIPTION OF THE INVENTION

Figure 1:
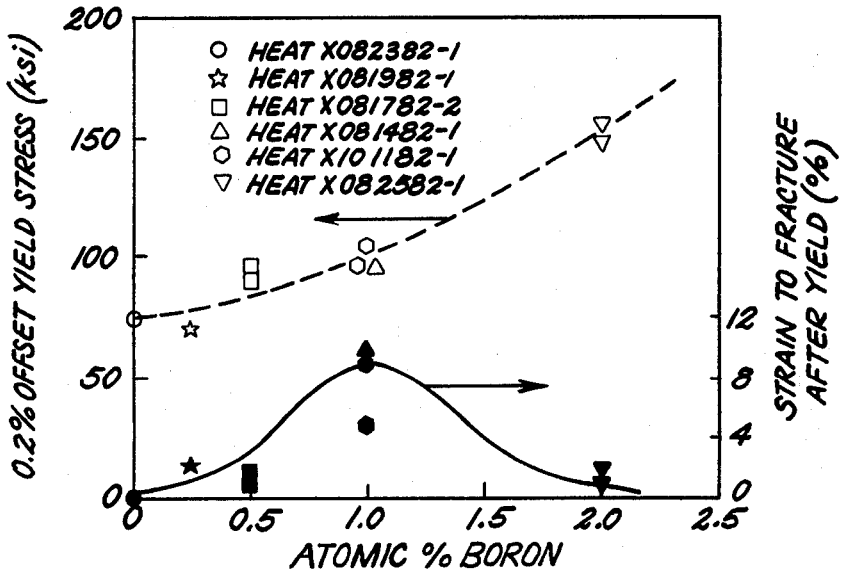
FIG. 1 is a graph of the 0.2% offset yield strength and strain to failure after yield of the intermetallic phase nickel aluminide ($Ni_3Al$) modified with 0, 0.25. 0.5, 1.0 and 2.0 atomic percent boron and cooled at a rate of at least about $10^{3°}$ C./sec versus atomic percent boron.

In the practice of this invention, an intermetallic phase having an $Ll_2$ type crystal structure is first selected. The selection criteria will depend upon the end use environment which, in turn, determines the attributes, such as strength, ductility, hardness, corrosion resistance and fatigue strength, required of the material selected.

An intermetallic phase typical of those of engineering interest and one having particularly desirable attributes is nickel aluminide ($Ni_3Al$) which is found in the nickel-aluminum binary system and as $\gamma'$ in $\gamma/\gamma'$ nickel-base superalloys. Nickel aluminide has high hardness and is stable and resistant to oxidation and corrosion at elevated temperatures which makes it attractive as a potential structural material. Although single crystals of $Ni_3Al$ exhibit good ductility in certain crystallographic orientations, the polycrystalline form, i.e., the form of primary significance from an engineering standpoint, has low ductility and fails in a brittle manner intergranularly.

Nickel aluminide, which has a face centered cubic (FCC) crystal structure of the $Cu_3Al$ type ($Ll_2$ in the Strukturbericht designation which is the designation used herein and in the appended claims) with a lattice parameter $a_o=3.589$ at 75 at.% Ni and melts in the range of from about 1385° to 1395° C., is formed from aluminum and nickel which have melting points of 660° and 1453° C., respectively, and FCC crystal structures of the Al type with cubic lattice parameters $a_o$ of 4.05Å and 3.52Å, respectively. Although frequently referred to as $Ni_3Al$, nickel aluminide is an intermetallic phase and not a compound as it exists over a range of compositions as a function of temperature, e.g., about 72.5 to 77 wt. % Ni (85.1 to 87.8 at.%) at 600° C.

The selected intermetallic phase is provided as a melt whose composition corresponds to that of the preselected intermetallic phase. The melt composition will consist essentially of the atoms of the two components of the intermetallic phase in an atomic ratio of approximately 3:1 and is modified with boron in an amount of from about 0.01 to 2.5 at.%. Generally, the components will be two different elements, but, while still maintaining the approximate atomic ratio of 3:1, one or more elements may, in some cases, be partially substituted for one or both of the two elements which form the intermetallic phase. Thus, the first component will be at least one element selected from the group consisting of Ni, Fe, Co, Cr, Mn, Mo, W and Re and the second component will be at least one element selected from the group consisting of Al, Ti, Nb, Ta, V, Si, Mo, W and Re. Although the melt should ideally consist only of the atoms of the intermetallic phase and atoms of boron, it is recognized that occasionally and inevitably other atoms of one or more incidental impurity atoms may be present in the melt.

The melt is next rapidly cooled at a rate of at least about $10^{3}$° C./sec to form a solid body, the principal phase of which is of the $Ll_2$ type crystal structure in either its ordered or disordered state. Thus, although the rapidly solidified solid body will principally have the same crystal structure as the preselected intermetallic phase, i.e., the $Ll_2$ type, the presence of other phases, e.g., borides, is possible. Since the cooling rates are high, it is also possible that the $Ll_2$ crystal structure of the rapidly solidified solid will be disordered, i.e., the atoms will be located at random sites on the crystal lattice instead of at specific periodic positions on the crystal lattice as is the case with ordered solid solutions.

There are several methods by which the requisite large cooling rates may be obtained, e.g., splat cooling. A preferred laboratory method for obtaining the requisite cooling rates is the chill-block melt spinning process.

Briefly and typically, in the chill-block melt spinning process molten metal is delivered from a crucible through a nozzle, usually under the pressure of an inert gas, to form a free-standing stream of liquid metal or a column of liquid metal in contact with the nozzle which is then impinged onto or otherwise placed in contact with a rapidly moving surface of a chill-block, i.e., a cooling substrate, made of a material such as copper. The material to be melted can be delivered to the crucible as separate solids of the elements required and melted therein by means such as an induction coil placed around the crucible or a "master alloy" can first be made, comminuted, and the comminuted particles placed in the crucible. When the liquid melt contacts the cold chill-block, it cools rapidly, from about $10^{3}$° C./sec to $10^{7}$° C./sec, and solidifies in the form a continuous length of a thin ribbon whose width is considerably larger than its thickness. A more detailed teaching of the chill-block melt spinning process may be found, for example, in U.S. Pat. Nos. 2,825,108, 4,221,257, and 4,282,921 which are herein incorporated by reference.

The following examples are provided by way of illustration and not by limitation to further teach the novel method of the invention and illustrate its many advantageous attributes:

EXAMPLE I

A heat of composition corresponding to about 3 atomic parts nickel to 1 atomic part aluminum was prepared, comminuted, and about 60 grams of the pieces were delivered into an alumina crucible of a chill-block melt spinning apparatus. The crucible terminated in a flat-bottomed exit section having a slot 0.25 (6.35 mm) inches by 25 mils (0.635 mm) therethrough. A chill block, in the form of a wheel having faces 10 inches (25.4 cm) in diameter with a thickness (rim) of 1.5 inches (3.8 cm), made of H-12 tool steel, was oriented vertically so that the rim surface could be used as the casting (chill) surface when the wheel was rotated about a horizontal axis passing through the centers of and perpendicular to the wheel faces. The crucible was placed in a vertically up orientation and brought to within about 1.2 to 1.6 mils (30–40μ) of the casting surface with the 0.25 inch length dimension of the slot oriented perpendicular to the direction of rotation of the wheel.

The wheel was rotated at 1200 rpm, the melt was heated to between about 1350° and 1450° C. and ejected as a rectangular stream onto the rotating chill surface under the pressure of argon at about 1.5 psi to produce a long ribbon which measured from about 40–70μ in thickness by about 0.25 inches in width.

EXAMPLE II

The procedure of Example I was repeated using the same equipment 5 more times using master heats of the nominal $Ni_3Al$ composition modified with 0.25, 0.50, 1.0 and 2.0 at .% boron (heats X081982-1, X081782-2, X082482-1 and X082582-1) and a second heat at 1.0 at.% boron (heat X101182-1).

Figure 2:
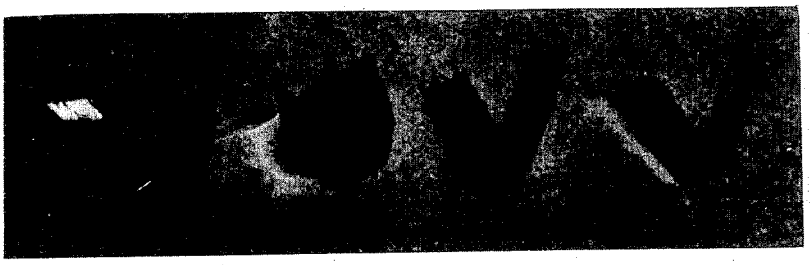
FIG. 2 is a photograph of ribbons of the intermetallic phase nickel aluminide modified with 0, 0.5, 1.0, and 2.0 atomic percent boron and cooled at a rate of at least about $10^{3°}$ C./sec following testing by means of the 180° bend test.

The completed ribbons were tested in tension without any preparation. The resulting 0.2% offset yield strength (0.2% flow stress) and strain to failure after yield (i.e., total plastic strain), $\epsilon_p$ are shown in FIG. 1 as a function of atomic percent boron. The total plastic strains reported in FIG. 1 should be regarded as minimum material properties since the thin ribbons are largely susceptible to premature failure induced by surface defects. Thus, the total plastic strain (ductility) would be expected to be much higher for bulk material in which surface defects will play a much less influential role. In fact, although not done for the ribbons of Examples I and II, the apparent ductility of ribbon-like specimens can generally be increased by mechanically polishing either the flat width surfaces or the edges, or both, to remove surface and near-surface defects and asperities. FIG. 2 qualitatively illustrates the improved ductility of nickel aluminide modified with boron when processed by the method of the instant invention via the 180° reverse bend test wherein the ribbons are, in this case, sharply bent 180° without the use of mandrels or guides.

Figure 3:
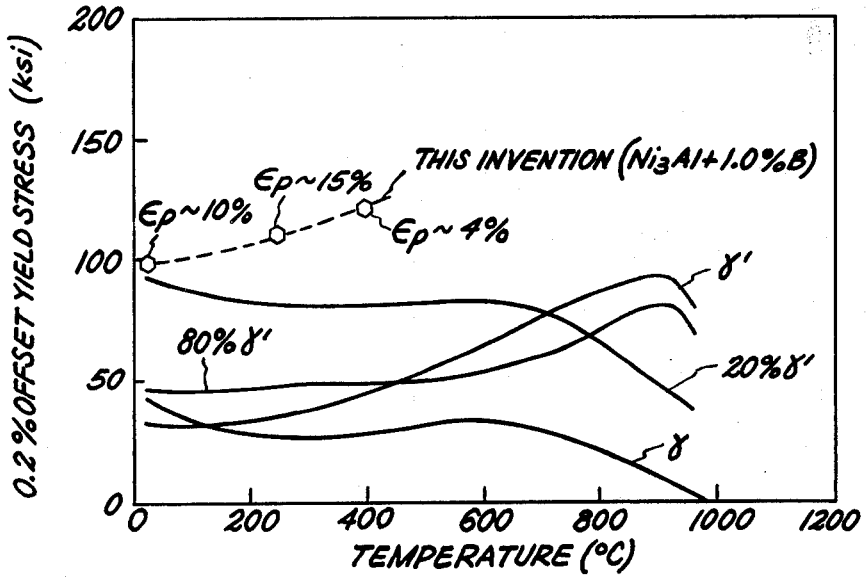
FIG. 3 is a graph of the 0.2% offset yield strength of the intermetallic phase nickel aluminide processed by the method of this invention with 1.0 at.% boron versus temperature. Also shown are the total plastic strains after yield for that nickel aluminide plus literature values of yield strength versus temperature for $\gamma'$ and $\gamma/\gamma'$ Ni-Cr-Al alloys having 0, 20 and 80%$\gamma'$ where $\gamma'$ is $Ni_3Al$ and $\gamma$ is a nickel-rich face centered cubic solid solution.

FIG. 3 shows the strength and ductility properties of the Example II ribbons having about 1.0 at.% boron as a function of temperature. Also shown on FIG. 3 are the strength properties for $\gamma'$ ($Ni_3Al$) and Ni-Cr-Al $\gamma/\gamma'$ alloys having 0, 20 and 80% $\gamma'$ (where $\gamma$ is a nickel-rich face centered cubic solid solution), processed by "conventional" methods not of the method of the instant invention, from Chapter 3 of the book *The Superalloys* edited by Sims and Hagel (John Wiley & Sons, 1972).

From the preceding description of the present invention in conjunction with the preferred embodiments thereof, it should be apparent to those skilled in the metallurgical arts that modifications and variations may be resorted to without departing from the spirit and scope of the invention which is limited only by the appended claims.

What is claimed is:

1. The method for achieving both improved high strength and improved ductility in intermetallic phases comprising the steps of:

(a) providing a melt whose composition substantially corresponds to that of a preselected intermetallic phase having a crystal structure of the $Ll_2$ type, said melt consisting essentially of a first component, a second component and incidental impurities, said melt being modified with boron in an amount of from about 0.25 to 2.0 atomic percent, said first component being at least one element selected from the group consisting of Ni, Fe, Co, Cr, Mn, Mo, W and Re, said second component being at least one element selected from the group consisting of Al, Ti, Nb, Ta, V, Si, Mo, W and Re, said first and second components being present in said melt in an atomic ratio of approximately 3:1, respectively, and (b) cooling the liquid metal of said melt at a cooling rate of at least about $10^{3°}$ C./sec to form a solid body, the principal phase of which is of the $Ll_2$ type crystal structure in either its ordered or disordered state.

2. The method of claim 1 wherein said boron is present in an amount of from about 0.25 to 1.75 atomic percent.

3. The method of claim 1 wherein said boron is present in an amount of from about 0.5 to 1.5 atomic percent.

4. The method of claim 1 wherein said boron is present in an amount of about 1.0 atomic percent.

5. The method of claim 1 wherein said cooling step is conducted by ejecting said liquid metal of said melt through a nozzle under the pressure of an inert gas causing said liquid metal to contact a rapidly moving surface of a cooling substrate whereupon said cooling at a rate of at least about $10^{3°}$ C./sec occurs.

6. The method for achieving both improved high strength and improved ductility in intermetallic phases comprising the steps of:

(a) providing a melt whose composition substantially corresponds to that of a preselected intermetallic phase having a crystal structure of the $Ll_2$ type, said melt consisting essentially of a first component, a second component and incidental impurities, said melt being modified with boron in an amount of from about 0.25 to 2.0 atomic percent, said first component being nickel and at least one element selected from the group consisting of Fe, Co, Cr, Mn, Mo, W and Re, said second component being aluminum and at least one element selected from the group consisting of Ti, Nb, Ta, V, Si, Mo, W and Re, said first and second components being present in said melt in an atomic ratio of approximately 3:1, respectively, and (b) cooling the liquid metal of said melt at a cooling rate of at least about $10^{3°}$ C./sec to form a solid body, the principal phase of which is of the $Ll_2$ type crystal structure in either its ordered or disordered state.

7. The method of claim 1 wherein said boron is present in an amount of from about 0.25 to 1.75 atomic percent.

8. The method of claim 1 wherein said boron is present in an amount of from about 0.5 to 1.5 atomic percent.

9. The method of claim 1 wherein said boron is present in an amount of about 1.0 atomic percent.

10. The method of claim 6 wherein said cooling step is conducted by ejecting said liquid metal of said melt through a nozzle under the pressure of an inert gas causing said liquid metal to contact a rapidly moving surface of a cooling substrate whereupon said cooling at a rate of at least about $10^{3°}$ C./sec occurs.

11. A solid body made by the method of claim 6.

12. The method for achieving both improved high strength and improved ductility in the intermetallic phase nickel aluminide comprising the steps of:

(i) providing a melt whose composition consists essentially of nickel and aluminum in an atomic ratio of approximately 3:1, respectively, boron in an amount of from about 0.25 to 2.0 atomic percent, and incidental impurities, and (ii) cooling the liquid metal of said melt at a cooling rate of at least about $10^{3°}$ C./sec to form a solid body, the principal phase of which is the $Ll_2$ type crystal structure in either its ordered or disordered state.

13. The method of claim 12 wherein said boron is present in an amount of from about 0.25 to 1.75 atomic percent.

14. The method of claim 12 wherein said boron is present in an amount of from about 0.5 to 1.5 atomic percent.

15. The method of claim 12 wherein said boron is present in an amount of about 1.0 atomic percent.

16. The method of claim 12 wherein said cooling step is conducted by ejecting said liquid metal of said melt through a nozzle under the pressure of an inert gas causing said liquid metal to contact a rapidly moving surface of a cooling substrate whereupon said cooling at a rate of at least about $10^{3°}$ C./sec occurs.

17. A solid body made by the method of claim 12.

18. The method for achieving both improved high strength and improved ductility in the intermetallic phase nickel aluminide comprising the steps of:

(a) providing a melt whose composition consists essentially of nickel and aluminum in an atomic ratio of approximately 3:1, respectively, boron in an amount of from about 0.25 to 2.0 atomic percent, and incidental impurities;

(b) ejecting the liquid metal of said melt through a nozzle under the pressure of an inert gas causing said liquid metal to contact a rapidly moving surface of a cooling substrate; and (c) cooling said liquid metal on said moving surface of said cooling substrate at a cooling rate of from about $10^{3°}$ C./sec to $10^{7°}$ C./sec forming thereby a solid in the form of a thin ribbon, the principal phase of said solid having a crystal structure of the $Ll_2$ type in either its ordered or disordered state.

19. The method of claim 18 wherein said boron is present in an amount of from about 0.25 to 1.75 atomic percent.

20. The method of claim 18 wherein said boron is present in an amount of from about 0.5 to 1.5 atomic percent.

21. The method of claim 18 wherein said boron is present in an amount of about 1.0 atomic percent.

22. A solid in the form of a thin ribbon made by the method of claim 19, said solid having a 0.2% offset yield strength of at least about 75 ksi and a strain to fracture after yield of at least about 2%.

23. A solid in the form of a thin ribbon made by the method of claim 20, said solid having a 0.2% offset yield strength of at least about 85 ksi and a strain to fracture after yield of at least about 4%.

24. A solid in the form of a thin ribbon made by the method of claim 21, said solid having a 0.2% offset yield strength of at least about 100 ksi and a strain to fracture after yield of at least about 6%.

* * * * *

UNITED STATES PATENT AND TRADEMARK OFFICE

CERTIFICATE OF CORRECTION

PATENT NO. : 4,478,791

DATED : October 23, 1984

INVENTOR(S) : Shyh-Chin Huang, Keh-Minn Chang, Alan I. Taub

It is certified that error appears in the above—identified patent and that said Letters Patent is hereby corrected as shown below:

Claim 7, line 1, delete "1" and insert therefor --6--.

Claim 8, line 1, delete "1" and insert therefor --6--.

Claim 9, line 1, delete "1" and insert therefor --6--.

Signed and Sealed this

*Twenty-second* Day of *October 1985*

[SEAL]

*Attest:*

DONALD J. QUIGG

*Attesting Officer*

*Commissioner of Patents and Trademarks—Designate*